US010932567B1

(12) United States Patent
Allen

(10) Patent No.: US 10,932,567 B1
(45) Date of Patent: Mar. 2, 2021

(54) LOCKER SEAT ASSEMBLY

(71) Applicant: Sam Allen, Maypearl, TX (US)

(72) Inventor: Sam Allen, Maypearl, TX (US)

( * ) Notice: Subject to any disclaimer, the term of this patent is extended or adjusted under 35 U.S.C. 154(b) by 0 days.

(21) Appl. No.: 16/798,692

(22) Filed: Feb. 24, 2020

Related U.S. Application Data

(63) Continuation-in-part of application No. 16/686,991, filed on Nov. 18, 2019, which is a continuation of application No. 16/423,942, filed on May 28, 2019, now Pat. No. 10,477,964, which is a continuation of application No. 16/140,788, filed on Sep. 25, 2018, now Pat. No. 10,299,583, which is a continuation of application No. 15/603,875, filed on May 24, 2017, now Pat. No. 10,080,433, which is a continuation-in-part of application No. 29/595,094, filed on Feb. 24, 2017, now Pat. No. Des. 826,602.

(51) Int. Cl.

| | |
|---|---|
| ***A47B 83/00*** | (2006.01) |
| ***A47C 1/00*** | (2006.01) |
| ***A47C 7/40*** | (2006.01) |
| ***A47C 15/00*** | (2006.01) |
| ***A47C 7/24*** | (2006.01) |

(52) U.S. Cl.
CPC ..... *A47B 83/00* (2013.01); *A47C 1/00* (2013.01); *A47C 7/24* (2013.01); *A47C 7/405* (2013.01); *A47C 7/407* (2013.01); *A47C 15/004* (2013.01)

(58) Field of Classification Search
CPC ..... A47B 83/00; A47B 96/00; A47B 85/00; A47B 85/08; A47B 2220/01; A47C 1/00; A47C 7/24; A47C 7/405; A47C 7/407; A47C 17/58
USPC ..... 297/188.04
See application file for complete search history.

(56) References Cited

U.S. PATENT DOCUMENTS

| | | | |
|---|---|---|---|
| 3,475,769 | A | 11/1969 | Fasanella |
| 4,596,420 | A | 6/1986 | Vaidya |
| D293,403 | S | 12/1987 | Umanoff et al. |
| 5,317,888 | A | 6/1994 | Towns |
| D372,603 | S | 8/1996 | Sacchio Lodispoto |
| 6,088,849 | A | 7/2000 | Lieber |
| 6,948,788 | B1 | 9/2005 | Tai |
| D606,181 | S | 12/2009 | Bock et al. |

(Continued)

OTHER PUBLICATIONS

Office Action dated Mar. 27, 2018 from corresponding U.S. Appl. No. 15/603,875.

(Continued)

*Primary Examiner* — Mark R Wendell
(74) *Attorney, Agent, or Firm* — James E. Walton

(57) ABSTRACT

A locker includes a pair of spaced-apart upstanding sidewalls having a pair of front edges. A generally horizontal seat extends between and at least partially forward of the front edges of the sidewalls. A lower seatback is positioned between the sidewalls and extends above the horizontal seat, the lower seatback is movable between an open position and a closed position using first lateral and vertical guides. An upper seatback is positioned between the sidewalls and extends above the horizontal seat and the lower seatback, the upper seatback is movable between an open position and a closed position using second lateral and vertical guides. Lateral guides include frame guides, structurally reinforced drawer slides, hinges, or runners. Vertical guides include frame guides, runners, or vertical lift mount assemblies. The seatback assembly at least partially covers a ventilated storage compartment.

20 Claims, 6 Drawing Sheets

(56) References Cited

U.S. PATENT DOCUMENTS

| | | | |
|---|---|---|---|
| 10,080,433 | B2 | 9/2018 | Allen |
| 10,299,583 | B2 | 5/2019 | Allen |
| 10,477,964 | B2 | 11/2019 | Allen |
| 2003/0222174 | A1 | 12/2003 | Saint-James |
| 2006/0080993 | A1 | 4/2006 | Mullen |
| 2011/0025181 | A1 | 2/2011 | Vinke |
| 2012/0086314 | A1 | 4/2012 | Bourke |
| 2013/0307382 | A1 | 11/2013 | Garrison |
| 2014/0327350 | A1 | 11/2014 | Tassin |
| 2016/0258108 | A1 | 9/2016 | Jindra et al. |
| 2019/0021493 | A1 | 1/2019 | Allen |

OTHER PUBLICATIONS

Amendment dated May 30, 2018 from corresponding U.S. Appl. No. 15/603,875.

Final Office Action dated Jun. 19, 2018 from corresponding U.S. Appl. No. 15/603,875.

Amendment After Final dated Jul. 24, 2018 from corresponding U.S. Appl. No. 15/603,875.

Notice of Allowance dated Aug. 3, 2018 from corresponding U.S. Appl. No. 15/603,875.

Office Action dated Nov. 21, 2018 from corresponding U.S. Appl. No. 16/140,788.

Notice of Publication dated Jan. 24, 2019 from corresponding U.S. Appl. No. 16/140,788.

Notice of Allowance dated Apr. 1, 2019 from corresponding U.S. Appl. No. 16/140,788.

Amendment dated Sep. 27, 2019 from corresponding U.S. Appl. No. 16/423,942.

Notice of Allowance dated Oct. 10, 2019 from corresponding U.S. Appl. No. 16/423,942.

Notice of Publication dated Sep. 13, 2019 from corresponding U.S. Appl. No. 16/423,942.

Office Action dated Sep. 11, 2019 from corresponding U.S. Appl. No. 16/423,942.

LOCKER SEAT ASSEMBLY

CROSS REFERENCE TO RELATED APPLICATIONS

This application is a continuation-in-part of U.S. patent application Ser. No. 16/686,991, filed 18 Nov. 2019, titled "Locker Seat Assembly," which is a continuation of U.S. patent application Ser. No. 16/423,942, filed 28 May 2019, titled "Locker Seat Assembly," which is a continuation of U.S. patent application Ser. No. 16/140,788, filed 25 Sep. 2018, titled "Locker Seat Assembly," which is a continuation of U.S. patent application Ser. No. 15/603,875, filed 24 May 2017, titled "Locker Seat Assembly," which is a continuation-in-part of U.S. patent application Ser. No. 29/595,094, filed 24 Feb. 2017, titled "Locker with Folding Seat Back," all of which are incorporated by reference herein for all purposes.

BACKGROUND

1. Field of the Invention

The present invention relates generally to improvements in lockers or storage cabinets used in athletic or sporting facilities, and more specifically to seating incorporated into such lockers.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

FIG. 6 is an enlarged, fragmentary section view of a portion of a locker of FIGS. 1 through 6.

Figure 1:
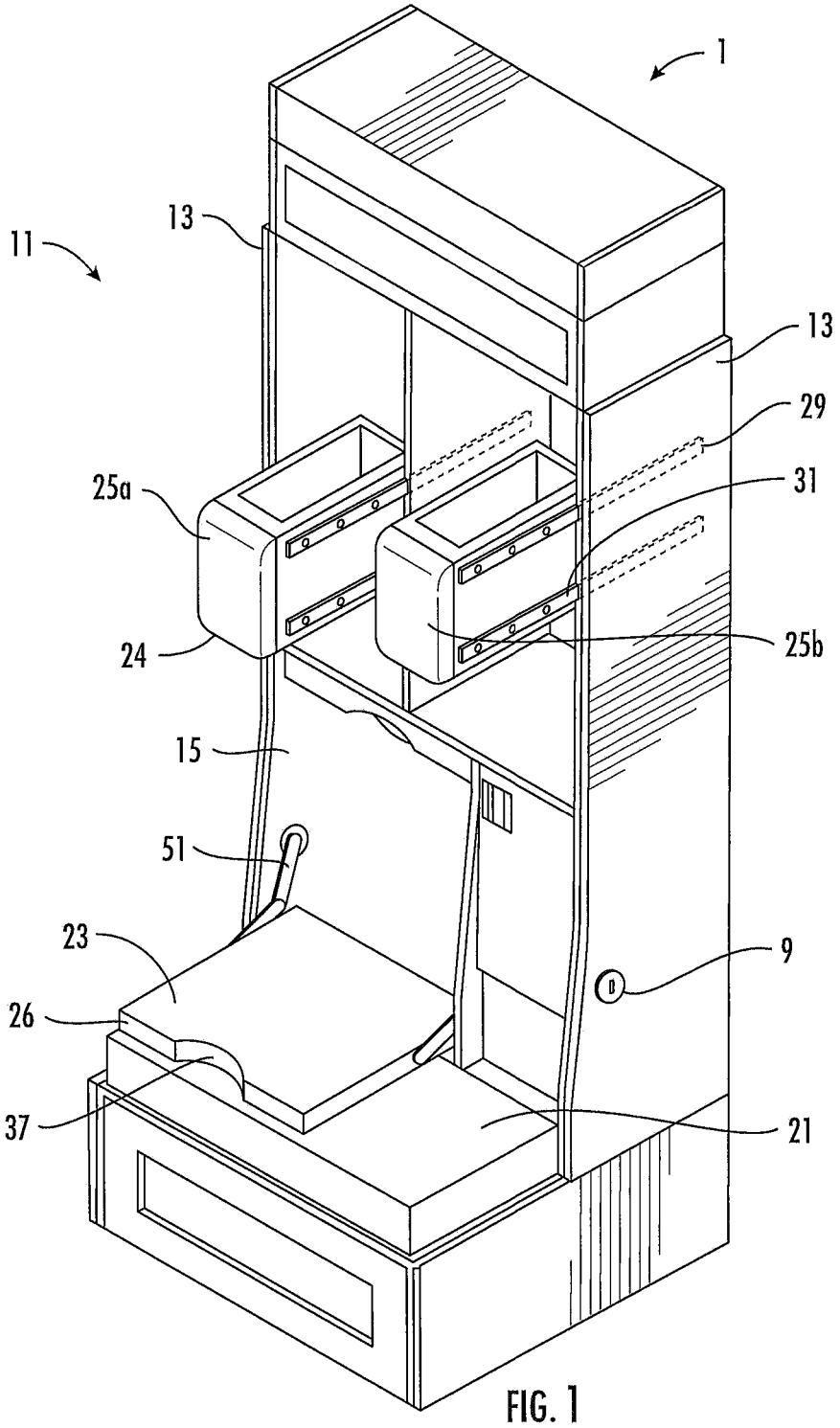
FIGS. 1 through 6 are perspective views of lockers incorporating the seat assembly according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker seat assembly are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIGS. 1 through 6 in the drawings, five configurations of lockers 1, 2, 3, 4, 5 each incorporating a locker seat assembly 11 according to the present application are illustrated. As can be seen, each locker 1, 2, 3, 4, 5 comprises a pair of upstanding sidewalls 13 that generally define the extent of the locker. Each locker may be installed adjacent to another, similar or identical locker, with its rear against a wall, and its front facing the interior of the locker room.

Between the sidewalls 13 of each locker 1, 2, 3, 4, 5 a plurality of compartments 15 are defined by shelves or other horizontally extending surfaces or platforms (only one compartment is indicated in each locker for clarity and simplicity). Multiple additional sidewalls may be placed between the "main" or exterior sidewalls 13 to define compartments and the like. As used herein, "sidewall" or "sidewalls" may refer to either "man" sidewalls 13 or other sidewalls arranged between the "main" sidewalls. Each compartment 15 may be sized and otherwise configured for storage of clothing or sporting equipment or other items 15 and may include a door, which may be lockable using lock 9.

Although the lock 9 is depicted as a standard pin tumbler lock, the lock 9 may include a numeric keypad, biometric access, voice-activated commands, network connections for administrator access, such as when lock combinations or codes are forgotten or for the locker resident/owner to grant authorized access remotely, and combinations thereof. The lock 9 may control locking/unlocking one or all of compartments 15 in a respective locker of lockers 1, 2, 3, 4, 5, including those adjacent to, associated with, or disposed within a headrest, seatback, or bench of the lockers 1, 2, 3, 4, 5. In a preferred embodiment, lock 9 is disposed in a sidewall 13. In other embodiments, lock 9 is disposed on a door of a compartment.

Each of the lockers 1, 2, 3, 4, 5 also incorporates a seat assembly 11 according to an embodiment of the present application. Each seat assembly 11 generally comprises a horizontal portion or bench 21, a lower seatback portion 23, and an upper seatback portion 25 according to the present application. Preferably, the upper seatback portion 25 is a headrest; however, in other embodiments, the upper seatback portion 25 may be configured as an extension of the lower seatback portion 23, where the lower seatback portion 23 is for lumbar support and the upper seatback portion 25 is for back and/or shoulder support. Bench 21, seatback 23, and headrest 25 may be disposed and extend between main sidewalls 13 or other sidewalls defined between the main sidewalls 13. Bench 21 may extend at least partially forward of the front edges of sidewalls 13 (see FIG. 1) and may be bordered by armrests or other structures raised above the sides of bench 21 (not shown).

The seatback 231*s* either straight or slightly inclined to the rear, to support the back of the person sitting on bench 21 (see FIGS. 1 through 5). Headrest 25 is either straight or slightly inclined to the front or the rear, to support a head of the person sitting on bench 21. Each headrest 25 is disposed generally above both the bench 21 and the seatback 23. In a preferred embodiment, the abutment of seatback 23 and headrest 25 portions with the locker, or its sidewalls, form a movement guide at their inner side extents respectively. In other embodiments, the seatback 23 and headrest 25 portions of the locker are connected at their inner side extents by guides, rails, moveable mounts, or hinges. Upper 23 and lower 25 portions are thus movable, independently of one another, about their respective guides, mounts and/or hinges, between open and closed positions (the open position or partial open position is shown in FIGS. 1 through 5). In a preferred embodiment, a stop is mounted to a sidewall or a shelf to stop the movement of the seatback 23 and headrest 25 assemblies and obtain a closed position. Bench 21 is adjacent the seatback 23 to form an elevation angle between the closed seatback 23 and the bench 21 that is greater than or equal to 90°.

FIGS. 1 through 5 are perspective views of lockers 1, 2, 3, 4, 5 illustrating seatback and head rest assemblies in an opened or partially opened position, with movement of the lower 23 and/or upper 25 portions enabled using movement guides. Preferably the movement guides include lateral guides 31, vertical guides 51, hinges 71, lift assemblies 91, or combinations thereof, which are mounted between sidewalls 13 on cross members extending between them. Further compartments or storage spaces 15 adjacent, behind, or below seatback portions are illustrated.

As shown in FIGS. 1 through 5, seatback portions 23, 25 may be generally aligned with the front edges of the sidewalls between which they are disposed, or may project forward or be recessed. Seatback portions 23, 25 preferably are padded and upholstered with an appropriate fabric, such as vinyl or leather or a textile material.

FIG. 1 depicts a perspective view of headrest 25 extended in partially opened positions. In the closed positions, the headrest 25 is above and to the rear of horizontal bench 21 in a generally vertical configuration. Seatback 23 swings down and up, between open and closed positions, rotating at an elevational angle that is approximately 90°.

As depicted in FIG. 1, headrest 25 is configured as two separate pullout drawers 25*a* and 25*b* having a cushioned front edge 24 that extends beyond a shelf of the locker 1 when open. Each drawer retracts to a collinear position relative to the shelf when closed. In the closed position, the front edge 24 of headrest 25 is adjacent upper edge 26 of lower seatback 23. Although depicted as a split-back seat, having two separate drawers 25*a*, 25*b* together with a vertical sidewall or partition separating the two drawers, other embodiments include a single pullout drawer without a partition.

The open position of the pull-out drawers 25*a*, 25*b* is created by the pull-out motion, exposing recesses or drawer compartments within each respective pull-out drawer 25*a*, 25*b*. Movement is a sliding movement occurring relative to grooves 29 formed in the sidewall 13 to slidingly cooperate with corresponding slide rails 31 formed in or attached to a respective drawer. It is noted that although FIG. 1 depicts pull-out drawers 25*a*, 25*b* disposed within separate locker compartments of the locker 1, in other embodiments the pull-out drawers 25*a*, 25*b* are positioned within the same locker compartment, having no partition between them. In these embodiments, a shelf or small/tight tolerance compartment of the locker 1 may support the sliding movement with a bearing rail moveably positioned between the drawers.

In at least one embodiment, the lateral guides 31 used for pullout drawers 25*a* and 25*b* do not use rails and grooves, but rather use one or more wooden slides or frame guides between sidewalls 13 for guiding the pullout drawers between open and closed positions. The one or more wooden slides or frame guides are formed by using tight dimension tolerances when forming the pullout drawer and its corresponding compartment into which it is inserted. In other embodiments, the guides can include runners and/or grooves to aid in guiding the drawer to the closed position and/or the open position, restricting unwanted left, right, up, or down movement.

In other embodiments, the lateral guides 31 include structurally reinforced, or heavy-duty, drawer slides or undermount slides that have a sliding rail and a guiding rail. For example, heavy-duty drawer slides that may be used are the Hettich KA3320, 10 in. to 60 in, heavy-duty slides, rated from 325-500 lbs. The structural reinforcements include, but are not limited to, increasing thickness of material (e.g., from 1/32 In. and 1/16 in. thickness to 1/8 In. and % in. thickness), changing the material type (e.g., from aluminum to galvanized steel), increasing a number of sliding supports (e.g., from 2-3 rollers and/or bearings to 4-6 rollers and/or bearings), using surface hardened ball bearings, adding one or more folds/bends in the drawer slides, and combinations thereof. Lateral guides 31 may also include additional features, such as soft-close, self-close, cushions, dampers, telescoping slides or guides, lift-release or lift-out lock, and combinations thereof. In at least one embodiment, lateral guides 31 are replaced with a linear C-shaped steel guide rail, with a bearing attachment seated within the channel of the guide rail. The bearing attachment attaches to the pullout drawer using a pin or stud seated within the bearing.

The lower seatback portion 23 uses vertical guides 51 to swing top edge 26 down, along the elevational angle, providing access to one or more compartments behind the seatback portion 23. In this embodiment, vertical guides 51 are knife hinges.

Recesses 37 may be formed in the upper and lower edges of lower 23 and upper 25 seatback portions that cooperate to form one or more apertures to facilitate opening the seatback. Recesses 37 may be of varying configuration (as shown in FIG. 1 through 5), curved or square/rectilinear, and may be provided in only one of lower 23 and upper 25 seatback portions, or not at all.

Figure 2:
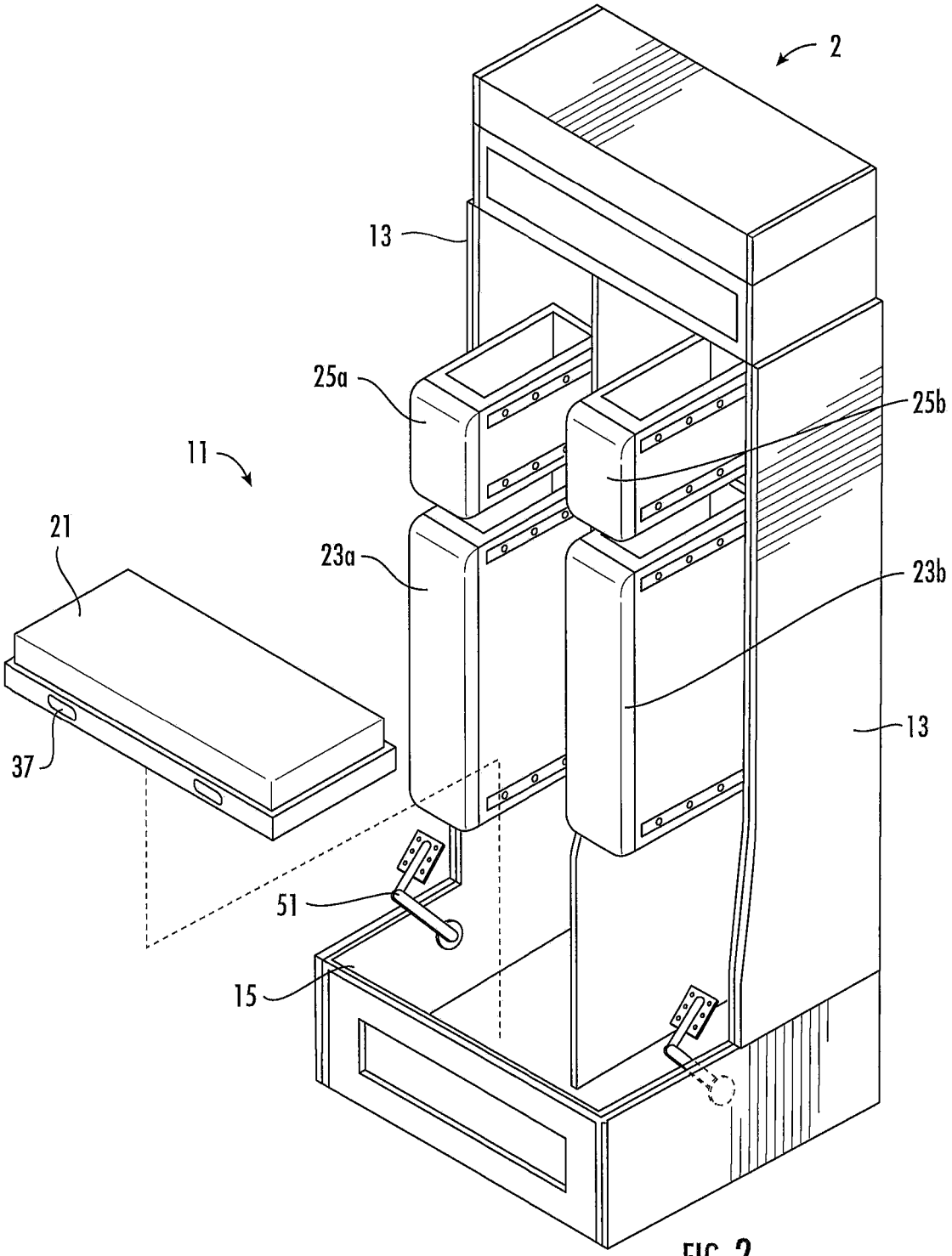

Referring now also to FIG. 2 in the drawings, the lower seatback portion 23 is configured as two separate pullout drawers 23*a* and 23*b*, and the upper headrest portion 25 is also configured as two separate pullout drawers 25*a* and 25*b*. The pullout motion of lower seatback portion 23 is enabled by guides for drawers 23*a*, 23*b* that are similar, if not identical, to those of pullout drawers 25*a* and 25*b*, as discussed above. In other embodiments, the dividing partition is removed and the lower seatback portion 25 is configured as a single pullout drawer, bin, or tub (FIG. 3 below).

Recesses 37 are formed in the outer or inner edges of bench 21 that cooperate to form one or more apertures to facilitate opening the bench 21. Recesses may be of varying configuration (as discussed above), and may not be provided at all.

Figure 3:
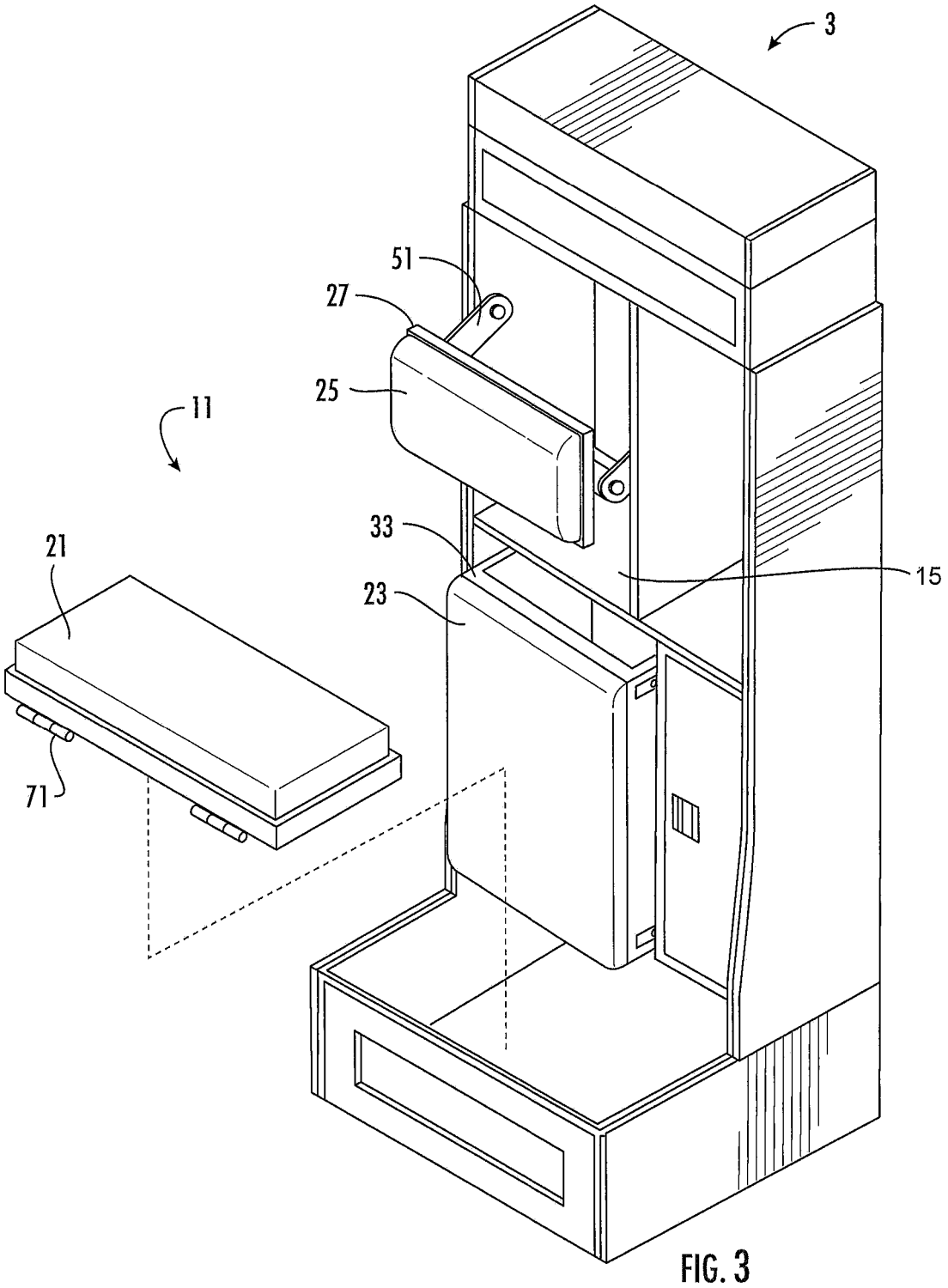
Figure 6:
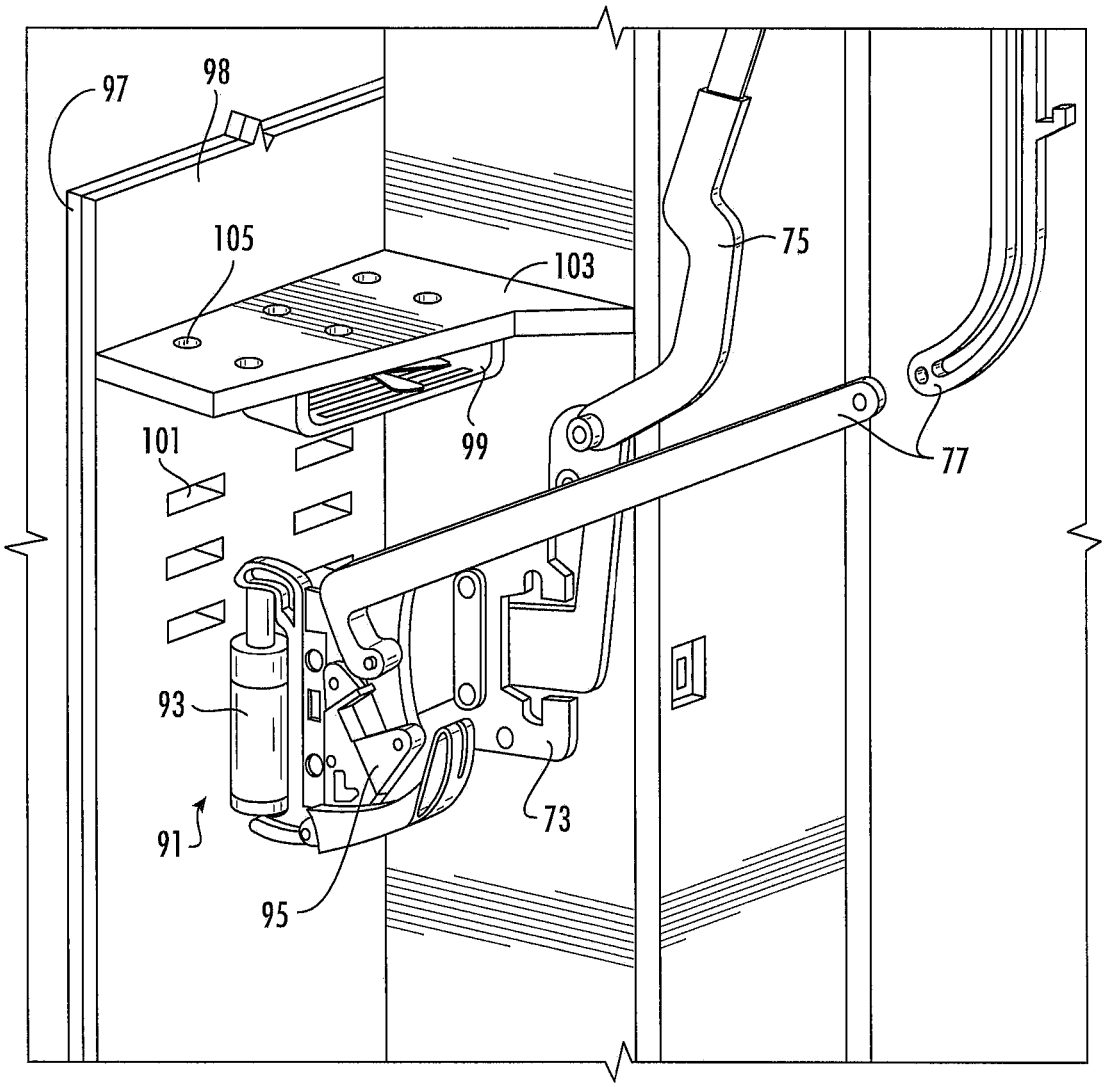

Referring now also to FIG. 3 in the drawings, the upper seatback portion, or headrest 25, is connected to a vertical lift out-and-up panel 27. In other embodiments, the direction of the vertical lift may change, such that panel 27 is a vertical lift out-and-down panel. In this embodiment, the vertical guides 51 includes sidewall bracket 73, lift arm 75, support strut 77, and a lift mount assembly 91 (FIG. 6 below). For example, a Häfele Strato lift-up fitting, without a transversal stabilization bar and with soft and silent closing features may be used for the attachment, such as the huwilift-verso/-strato, Item no. 372.68.804 or Part No. 03.3684.001.004. Other vertical lift mounts similar to the Häfele Strato lift-up fitting can also be used for the seatback assembly.

The lower seatback portion 23 is a single pullout drawer, bin, or tub 33. In other embodiments, the single pullout drawer, bin or tub 33 is replaceable with two pullout drawers within a mountable rack or casing, similar to the pullout drawers 23*a*, 23*b*, except that there is no need for a center partition, due to the mountable rack/casing.

The bench 21 is hinged, using hinges 71. Hinges 71 include one or more of a concealed, flag, continuous, latch, off-set, spring-loaded, stop, soft-close, knuckle hinge, or a combination thereof. In a preferred embodiment, hinges 71 are screw-on, knuckle hinges.

Figure 4:
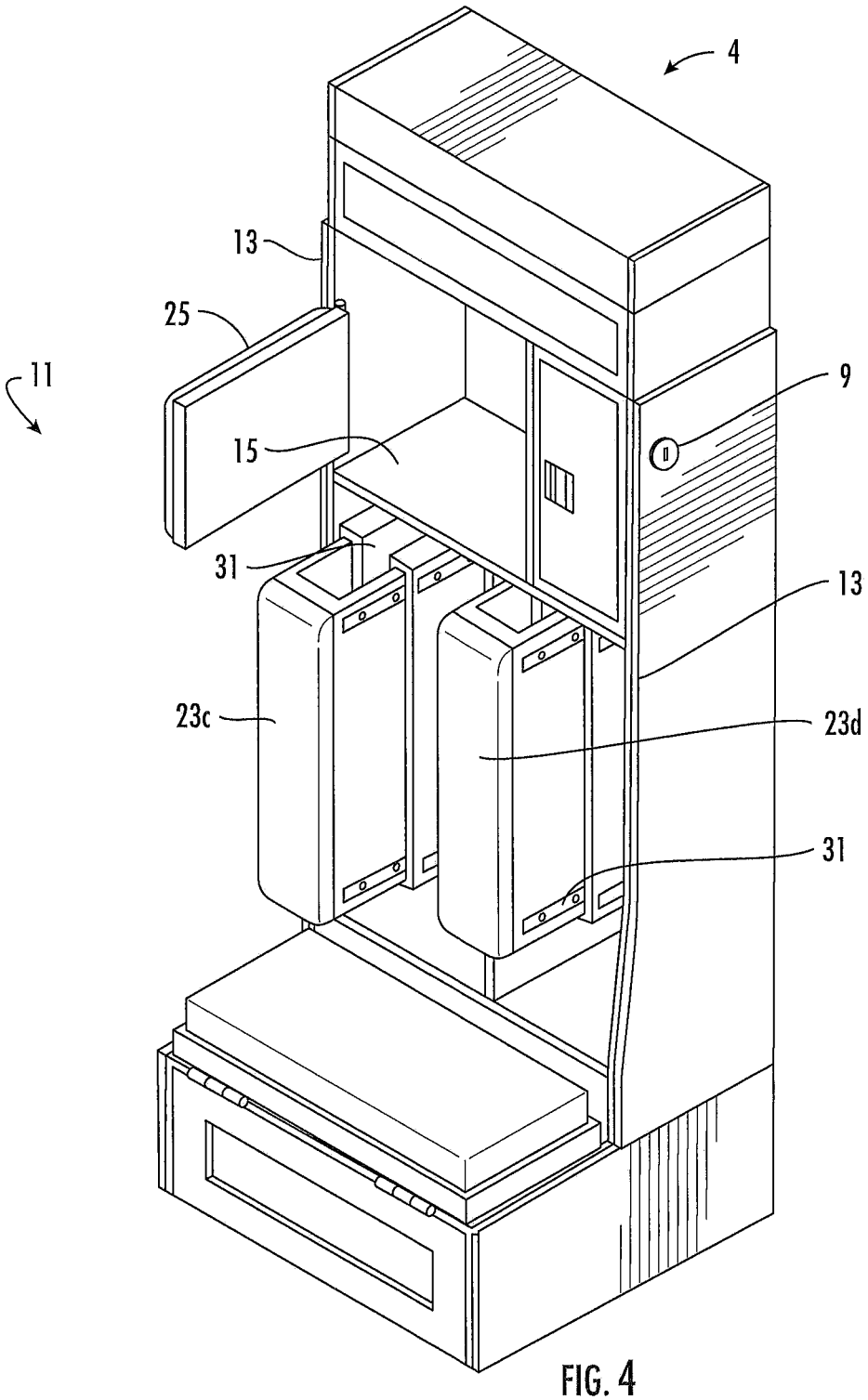

Referring now also to FIG. 4 in the drawings, the lower seatback portion 23 is configured as two separate, telescopic pullout drawers 23*c* and 23*d*. Although these drawers are depicted as separate, telescopic drawers, these drawers may be replaced by a single pullout drawer, bin, or tub 33, or by separate, non-telescopic drawers 23*a*, 23*b*. In a preferred embodiment, lateral guides 31 for pullout drawers 23*c* and 23*d* Include sleeves and drawer slides. The headrest 25 swings along an azimuth angle using one or more hinges 71.

Figure 5:
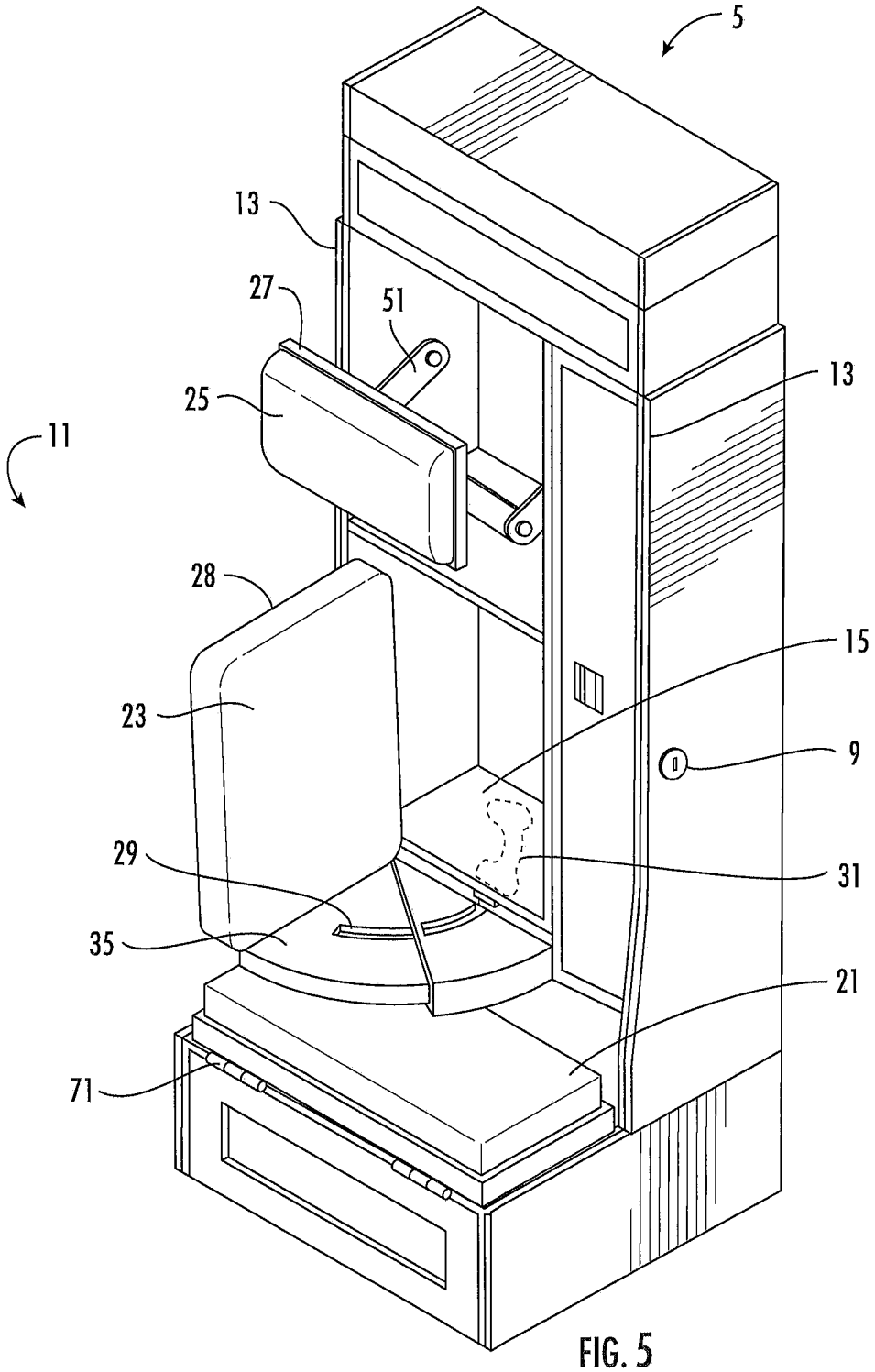

Referring now also to FIG. 5 in the drawings, the lower seatback portion 23 has top edge 28 opened at an azimuth angle relative to sidewall 13, using one or more hinges 71. In at least one embodiment, a telescopic shelf 35 is connected to the seatback portion 23. The telescopic shelf 35 extends to a full arc length when the lower seatback portion 23 is fully open, and retracts to a storage position having a shorter arc length when the lower seatback portion 23 is swung closed. The telescopic motion is facilitated by curved grooves 29 formed in the shelf 35 to slidingly cooperate with corresponding curved slide rails 31. The headrest 25 in this seat assembly 11 is connected to a vertical lift out-and-up panel 27, incorporating a vertical guide 51.

Referring now also to FIG. 6 in the drawings, a lift mount assembly 91 is Illustrated. The lift mount assembly 91 includes, but is not limited to, a sidewall bracket 73, a hydraulic cylinder 93 with cylinder stop, and a spring-biased hinge guide 95. It is noted that although a single side (e.g., right side) mount is depicted in FIG. 6, it will be understood that the present application encompasses both sides (e.g., right and left side), with the other side of the mount having similar, if not identical, components as the side mount assembly illustrated. It is further noted that a single, center-oriented vertical "out-and-up" or "out-and-down" mount attached to a shelf in a locker that is above or below the lower 23 or upper 25 seatback portion is also encompassed by the present application.

A plenum 97 may be mounted on the rear or exterior side of back wall 98. The plenum 97 may be connected via duct work (not shown) to an internal or external air source 99, such as a blower, fan, or the existing HVAC of the locker room or room in which locker is disposed or situated. The air source 99 to which plenum 97 is connected may be conventional, or may be a dedicated, custom system for the lockers 1, 2, 3, 4, 5. The air source 99 thus provides heated, cooled, and/or dehumidified air to each locker 1, 2, 3, 4, 5 and/or a storage compartment through the plenum 97.

The plenum 97 may communicate air from the air source 99 to the interior and various compartments 15 of lockers 1, 2, 3, 4, 5 through a plurality of ventilation apertures 101 or grilles formed in back wall 98 of locker 1, 2, 3, 4, 5. Preferably, a grille or aperture (grille is used herein to mean a single aperture or a group of apertures in any arrangement, e.g. circles, squares, other shapes, arranged in any pattern) is arranged through the back wall 98 at at least an upper extent and a lower extent (near the top and near the bottom) of locker 1, 2, 3, 4, 5 to insure a supply of air to the entirety of the locker or at least the upper and lower compartments thereof.

The apertures/grilles 101 may preferably be provided with a damper arrangement or mechanism that permits the partial closure or obstruction of the aperture(s) of the grilles to control the flow of air from the plenum 97. One or more front or forward ventilation grilles may be provided in the front panels or surfaces (forward of the back wall and generally between sidewalls 13) of locker 1, 2, 3, 4, 5 to permit exhaust or intake of air from or to the locker. Alternatively the natural gaps left between doors and openings in locker 1, 2, 3, 4, 5 can provide the exhaust or intake of air. The grilles and their dampers may be controlled (opened or closed, fully or partially) manually pr automatically, as by a programmed computer. Automatically controlled grilles may operate on a "schedule" (e.g. open or closed at night or during daylight hours) or according to airflow or other parameters, such as relative humidity in the locker room and the like.

Thus, airflow may be established through locker 1, 2, 3, 4, 5 from the plenum 97 through the ventilation grille and exits locker 1, 2, 3, 4, 5 through another ventilation grille or other openings in the front or forward portions of locker. Alternatively, air circulated through the locker may be exhausted through a duct or conduit to an area remote from lockers 1, 2, 3, 4, 5 and/or the locker room or building in which they are located. This circulation may be assisted by one or more circulation fans 99. Circulation fan 99 may be mounted to the upper or lower surface of a shelf 103, and the shelf 103 may be provided with flow apertures 105 so that the fan can circulate air between the compartments separated by the shelf 103 to insure circulation through the entirety of locker 1, 2, 3, 4, 5. In the embodiment of FIG. 6, for example, fan 99 is mounted under a shelf that forms a helmet storage compartment. Vent holes or apertures 105 in the shelf 103 permit circulation of air from fan 99 up into the helmet resting on the shelf 103. A preferred fan 99 is an Arctic F12 Silent 120 mm fan available from ARCTIC GmbH, Fasanenkamp 12, 38108 Braunschweig, Germany.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. A locker, comprising:
a pair of upstanding sidewalls;
a seat assembly disposed between the sidewalls, comprising:
a generally horizontal seat bench; and
a multi-piece seatback, comprising:
a cushioned seatback;
a cushioned headrest; and
a movement guide;
wherein at least one of the seatback and the headrest is moveable between an open and closed position;
wherein the movement of the at least one of the seatback and the headrest includes a pullout movement;
wherein the movement guide is disposed between the pair of upstanding sidewalls for guiding the movement between the open and closed position.

2. The locker according to claim 1, further comprising:
a lift mount assembly connected to the at least one of the seatback and the headrest to hold the open position when a user stops the movement at the open position.

3. The locker according to claim 1, wherein the movement guide comprises:
one or more lateral guides.

4. The locker according to claim 3, wherein the one or more lateral guides comprises:
at least one drawer slide.

5. The locker according to claim 1, wherein the movement guide comprises:
one or more vertical guides.

6. The locker according to claim 5, wherein the one or more vertical guides comprises:
at least one of a knife hinge and a lift mount assembly.

7. The locker according to claim 1, wherein the headrest is split-back.

8. The locker according to claim 1, wherein the seatback is split-back.

9. The locker according to claim 1, wherein the movement further comprises:
a pullout and up movement.

10. The locker according to claim 1, wherein the movement further comprises:
a pullout and swinging or rotating movement.

11. The locker according to claim 1, wherein a first edge of the headrest and a second edge of the seatback, when in the closed position, abut each other.

12. The locker according to claim 1, further comprising:
one or more storage compartments disposed adjacent a moveable portion of the seatback assembly.

13. The locker according to claim 12, wherein the one or more storage compartments is inaccessible in the closed position and accessible in the open position.

14. The locker according to claim 1, further comprising:
a telescopic shelf or drawer connected to the seatback.

15. The locker according to claim 14, further comprising:
a curved groove formed in the telescopic shelf for guiding the seatback between the open and closed positions.

16. The locker according to claim 1, further comprising:
a lock disposed in a sidewall of the pair of upstanding sidewalls.

17. The locker according to claim 1, further comprising:
an air source; and
a plenum for distributing airflow from the air source throughout the locker.

18. The locker according to claim 15, further comprising:
a plurality of apertures formed in at least one of a back wall and a shelf of the locker for facilitating the distribution of airflow.

19. A locker, comprising:
a pair of upstanding sidewalls;
a seat assembly disposed between the sidewalls, comprising:
a generally horizontal seat bench having a first recess disposed adjacent the seat bench; and
a multi-piece seatback, comprising:
a seatback having a second recess disposed adjacent the seatback; and
a headrest having a third recess disposed adjacent the headrest;
wherein at least one of the seatback, the headrest, and the seat bench is moveable between an open and closed position;
wherein at least one of the first recess, the second recess, and the third recess is inaccessible in the closed position;
wherein at least one of the first recess, the second recess, and the third recess is at least partially accessible in the opened position; and
a movement guide disposed between the pair of upstanding sidewalls for guiding the moveable portion of the seat assembly between the open and closed position.

20. A locker, comprising:
a pair of upstanding sidewalls;
a seat assembly disposed between the sidewalls, comprising:
a generally horizontal seat bench, having a first compartment disposed adjacent the seat bench, extendable from the locker between an open and a closed position; and
a multi-piece seatback, comprising:
a seatback, having a second compartment disposed adjacent the seatback, extendable from the locker between an open position and a closed position; and
a headrest, having a third compartment disposed adjacent the headrest, extendable from the locker between an open position and a closed position;
wherein the first compartment, the second compartment, and the third compartment are inaccessible in the closed positions;
wherein the first compartment and the second compartment are at least partially accessible in the opened positions; and
a plurality of movement guides disposed between the pair of upstanding sidewalls for guiding the seat bench, the seatback, and the headrest of the seat assembly between the open and closed positions.

* * * * *